US006159597A

United States Patent [19]

Meerman et al.

[11] Patent Number: 6,159,597

[45] Date of Patent: Dec. 12, 2000

[54] CENTRIFUGAL SPINNING PROCESS FOR SPINNABLE SOLUTIONS

[75] Inventors: Johannes Jacobus Meerman; Roelof Jelijs, both of Arnhem, Netherlands

[73] Assignee: AKZO Nobel NV, Arnhem, Netherlands

[21] Appl. No.: 08/894,964

[22] PCT Filed: Mar. 1, 1996

[86] PCT No.: PCT/EP96/00914

§ 371 Date: Dec. 3, 1997

§ 102(e) Date: Dec. 3, 1997

[87] PCT Pub. No.: WO96/27700

PCT Pub. Date: Sep. 12, 1996

[51] Int. Cl.[7] ..... B32B 19/00

[52] U.S. Cl. ..... 428/357; 428/397; 428/392; 428/400; 264/211.1; 264/209.3; 264/177.13; 264/183; 264/211.14; 264/211.15; 264/211.22; 264/211.24

[58] Field of Search ..... 428/402, 364, 428/359, 357, 401, 397, 400, 392; 528/148; 264/140, 143, 138, 349, 211.12, 209.3, 177.13, 183, 211.14, 211.18, 211.16, 211.22, 212, 211.24

[56] References Cited

U.S. PATENT DOCUMENTS

| | | | |
|---|---|---|---|
| 4,308,374 | 12/1981 | Volbracht et al. | 528/336 |
| 4,320,081 | 3/1982 | Lammers | 264/184 |
| 4,485,055 | 11/1984 | Bung et al. | 264/8 |
| 5,104,599 | 4/1992 | Prevorsek et al. | 264/140 |
| 5,151,390 | 9/1992 | Aoki et al. | 501/95 |
| 5,225,489 | 7/1993 | Prevorsek et al. | 525/151 |
| 5,436,398 | 7/1995 | Shimizu et al. | 525/475 |

FOREIGN PATENT DOCUMENTS

| | | | |
|---|---|---|---|
| 071 085 | 2/1983 | European Pat. Off. | D01D 5/18 |
| 54-27021 | 3/1979 | Japan | D01F 6/60 |
| 92 8999 | 12/1992 | Rep. of Korea | D01F 6/60 |

*Primary Examiner*—Merrick Dixon
*Attorney, Agent, or Firm*—Oliff & Berridge, PLC

[57] ABSTRACT

The invention pertains to a process for spinning fibers or filaments from a spinnable solution using a centrifuge of which the wall has one or more spinning orifices, in which process the spinnable solution is jetted from the centrifuge into a coagulant inside a jacket. The inner radius of the jacket is at least 35% wider than the radius of the outer circumference of the centrifuge, thus allowing the process' productive capacity to be increased. In addition, the fibers or filaments made by this process have very favorable pulp properties.

17 Claims, 1 Drawing Sheet

CENTRIFUGAL SPINNING PROCESS FOR SPINNABLE SOLUTIONS

Figure 1:
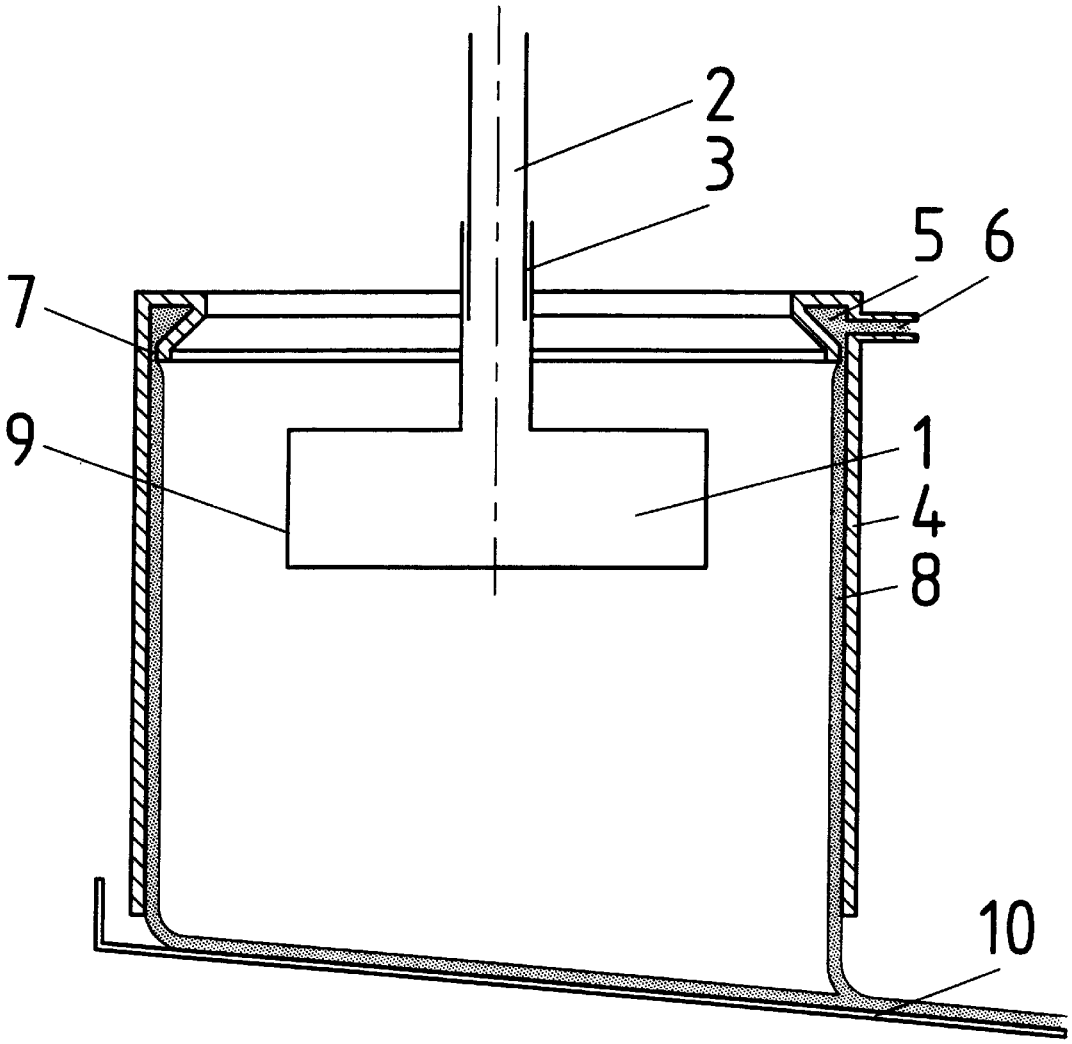

The invention pertains to a process for spinning fibres or filaments from a spinnable solution using a centrifuge of which the wall has one or more spinning orifices, in which process the spinning solution is jetted from the centrifuge into a coagulant inside a jacket.

Such a process is known. In Japanese laid open patent application JP 27021/79 it is described how an optically anisotropic spinning solution of a para-aramid, e.g., poly (paraphenylene terephthalamide), is spun with the aid of a centrifuge. Four examples serve to explain how the solution is introduced into a centrifuge having 25 or 50 spinning orifices of 0.08 or 0.1 mm in diameter and extruded through the spinning orifices at a rotational speed in the range of 70 to 1000 revolutions per minute (rpm). The solution then ends up in a coagulant flowing downward at 2 or 5 cm distance from the centrifuge. The coagulated fibres are collected batchwise and washed for 24 hours. The properties of the resulting fibres are such as will give them a certain commercial value.

Such a process has a low productive capacity and high times of passage, int. al., because the fibres are processed batchwise.

One way of increasing the productive capacity consists in raising the centrifuge's rotational speed. However, doing so has other highly disadvantageous effects, which accounts for the comparatively low rotational speeds in the examples of the aforementioned patent application. The maximum rotational speed at which fibres of fair quality can actually be spun using the above-described technique is of the order of 1000 rpm. Rotational speeds in excess of this recommended value produce an unacceptable number of fibre breaks. Moreover, aerosol is formed between the centrifuge and the coagulant flowing along the jacket. Such conditions produce poor and irregular fibre properties (tobacco-like appearance) as well as a dangerous and contaminated working environment due to the aerosol often containing a strong acid.

Fibre properties have to satisfy ever higher demands. In a conventional wet spinning process, such as described in U.S. Pat. No. 4,320,081, the resulting fibres have properties substantially superior to those of the fibres obtained by the process according to the aforementioned Japanese patent application (higher strength and modulus). A conventional wet spinning process employs a large number of spinning orifices per spinneret (say, 1000), so the productive capacity is high also. However, because of the comparatively low winding speed (some hundreds of meters per minute), which is comparable to the productive capacity per spinning orifice, and the process's high susceptibility to foreign substances in the spinning solution (requiring thorough filtration and shutting down of the process when one or more of the spinning orifices has clogged up), this process also produces an expensive product. Especially when it is to be processed into pulp, which is used, e.g., as friction and packing material, such a fibre is really too expensive.

In other words, what is wanted is a process having a higher productive capacity than the existing wet spinning processes and by means of which fibres can be made which are less expensive and possess comparable or superior properties for a particular purpose, such as pulp. Preferably, it should be possible to spin less pure spinning solutions and spinning solutions made of already somewhat coagulated polymers by means of such a process.

These objectives are attained using the process according to the invention, by centrifugally spinning a spinnable solution, with the inner radius of the jacket being at least 35% wider than the radius of the outer circumference of the centrifuge.

Preferably, the inner radius of the jacket is at least 50% wider than the radius of the outer circumference of the centrifuge and does not exceed 350% or, more preferably, 200%.

It was found that this will make it possible to substantially increase the rotational speed of the centrifuge, even to 5000 rpm or higher per minute. Further, the process according to the invention allows larger draw ratios and the average fibre length can be set arbitrarily, so that the production of endless filaments also becomes possible.

The formation of aerosol (when using liquid coagulants) has reduced significantly, probably because the fibres hardly disturb the coagulant surface as they are laid.

It should be noted that Korean patent specification KR 9208999 discloses a process for manufacturing staple fibres of polyaramid in which liquid-crystalline prepolymers are fed to a rotary apparatus and then extruded as a dispersion through the spinning orifices in the wall of the apparatus. In other words, this is not a case of a spinnable solution of a prepared polymer. The prepolymers end up in a polymerisation promoting medium flowing downwards along the wall of a vessel. The diameter of the vessel is 1.1 to 5.0 times that of the rotary apparatus. The process is hard to control because it requires not only good fibre spinning, coagulation, and discharge, but also a proper polymerisation process and the satisfactory conclusion thereof. Moreover, the staple fibres obtained have a low tensile strength and a structure which is more critical to fibrillate.

KR 9104700 also discloses a process relating to the spinning of prepolymers. The prepolymer is fed to a rotating nozzle, and the rotational speed and extrusion speed are selected to ensure that the ratio of the centrifugal force to the extrusion force exceeds at least 10.

EP 71085 discloses the production of "formed particles" of substantially equal size (narrow particle size distribution) by depositing a polymer dispersion, melt, or solution onto a rotating disc. Thus, still fluid droplets, fibres or lamellae are hurled radially into a fixating agent. EP 71085 does not address the problems encountered in the production of fibres and filaments via the use of a centrifuge operated at high speed.

It has proved possible to enhance the fibre properties and the productive capacity of the process not only by selecting a proportionally large jacket diameter, but also by centrifugally spinning a spinnable solution with the angular velocity of the centrifuge multiplied by the inner diameter of the jacket exceeding 20 m/s.

The product of the angular velocity of the centrifuge (in rad/s) and the inner radius of the jacket (in m) will be referred to as "take-off speed" (in m/s) hereinafter.

Preferably, the take-off speed is higher than 40 m/s, or even higher than 60 m/s and lower than 600 m/s, more preferably lower than 400 m/s.

Within the framework of this invention, the term "spinnable solution" is used to denote solutions of a polymer which can be converted into man-made fibres or filaments by extrusion and subsequent solidification. Preferably, the spinnable solutions are made by dissolving a prepared polymer in a suitable solvent.

In addition to the solutions of polymers mentioned in JP27021/79, the term "spinnable solution" comprises, int. al., solutions of meta-aramid, cellulose, and cellulose derivatives.

Preferably, the spinnable solution exhibits optical anisotropy. Solutions are considered to be anisotropic if birefringence is observed in a condition of rest. Generally speaking, this holds for measurements carried out at room temperature. However, within the framework of the present invention solutions which can be processed at temperatures below room temperature and which display anisotropy at said lower temperature are considered anisotropic also. Preference is given to solutions which are anisotropic at room temperature.

Visual determination of the isotropy or anisotropy is performed with the aid of a polarisation microscope (Leitz Orthoplan-Pol (100×)). To this end about 100 mg of the solution to be defined is arranged between two slides and placed on a Mettler FP 82 hot-stage plate, after which the heating is switched on and the specimen heated at a rate of about 5° C./min. In the transition from anisotropic to isotropic, i.e., from coloured to black, the temperature is read off at virtual black.

With a strength greater than 13 cN/dtex, of even greater than 20 cN/dtex, an elongation of 2–5%, and a modulus of 40–50 GPa, fibres of poly(paraphenylene terephthalamide) spun at take-off speeds of higher than 20 m/s are comparable with fibres spun by means of a conventional wet spinning process. Moreover, they were found to be highly suitable for making pulp, even more suitable in fact than fibres obtained by means of a conventional wet spinning process (see Examples, especially Table 3).

It is also observed—perhaps unnecessarily—that the invention also has the aforementioned advantages at low rotational speeds, although in that case the productive capacity will be low also.

Surprisingly, it has been found that because of the combination of reduced fibre breaks (or even no fibre breaks at all) and the increased productive capacity now available, the fibres which "fall" from the bottom of the jacket at the same time as the coagulant can be joined together to form a sliver. The two parameters, i.e., a sufficient number of fibres and a sufficient fibre length, play a major part in the cohesion of such a sliver. If because of a high productive capacity (sufficient fibres) and reduced fibre breaks or no breaks at all (long fibres) the sliver has sufficient cohesion, it can be neutralised, washed, dried, and cut in a continuous process.

One example of a product which can be manufactured directly from said sliver is cigarette filters. By spinning a solution of cellulose acetate into a nitrogen atmosphere (in this case the coagulant is a gas), the solvent evaporates, resulting in a solidified sliver which can be made directly into cigarette filters.

Holding good irrespective of the end product (textiles, composites, packings, brake shoes, and the like) is that the difference between the inner radius of the jacket and the outer radius of the centrifuge (the so-called airgap) preferably is more than 7 cm.

Centrifuges having a diameter of more than 20 cm and less than 60 cm are highly suited to be used in the process according to the invention. Such a centrifuge is large enough to guarantee good productive capacity, yet small enough to keep the construction of the spinning machine simple.

The rotational speed of the centrifuge preferably is in the range of 1000 to 5000 rpm. As was stated earlier, a rotational speed of less than 1000 rpm makes for a too low productive capacity. Good fibres can still be made at rotational speeds exceeding 5000 rpm. However, at such speeds the process is less easy to control, and the centrifuge is subjected to high mechanical load.

In addition, the centrifuge is preferably provided with means (such as a so-called viscous seal) which permit the spinning solution to be supplied under pressure. This makes it possible to enforce a spinning solution throughput, which will improve the controllability of the process, especially of the draw ratio.

It will also make for improved safety, since the spinning solution, which often contains strong acid, can only exit through the spinning orifices, where it is collected by the jacket and discharged in the usual manner.

The number of spinning orifices is not essential in itself and can be selected on the basis of common considerations (sufficient space between the spinning orifices, risk of filament or fibre sticking, productive capacity). In the process according to the invention, the number will generally be in the range of 40 to 1000, but a number of, say, 10,000 is not ruled out (especially for centrifuges with a large diameter).

The diameter of the spinning orifices plays an important part in the centrifugal spinning process according to the invention. As this diameter increases, the risk of clogging as a result of foreign substances in the spinning solution is reduced, so that less thorough filtration is required. Moreover, when the diameter is larger, it is possible to spin a spinning solution made wholly or in part of polymer which is already somewhat coagulated, for instance residual products of the spinning process.

As was stated earlier, pulp made of fibres produced by the process according to the invention has favourable properties. This is evident, int. al., from the high strength of products made of this pulp. Surprisingly, it has been found that these properties can be enhanced still further by increasing the diameter of the spinning orifices. It is for these reasons that the diameter of the spinning orifice or spinning orifices preferably exceeds 30 $\mu$m. Optimum results are obtained when the diameter is greater than 120 $\mu$m and smaller than 500 $\mu$m.

The properties of pulp made in this way are superior to those of pulp made of fibres produced by a conventional wet spinning process, and the pulp is also much less expensive. The reason for the superior properties is not fully known, but it is a fact that fibres made by the process according to the invention have a number of features not previously observed. For instance, it has been found that the fibres have a number of elongated and/or spherical voids (with a diameter usually in the range of about 30–40% of the fibre diameter and a volume fraction relative to the total fibre volume ranging from, e.g., 0.1–0.2). In addition, contrary to what the person skilled in art would expect, the polymer structure at and beneath the fibre surface is essentially the same as the polymer structure in the fibre core, and the fibre diameter range (linear density range) is wider with a larger spinning orifice diameter. A larger average linear density, higher than 2 dtex and preferably higher than 4 dtex, was also found to have a favourable effect on the pulp properties in the case of fibres made by a process according to the invention.

It should be noted that fibres having a linear density smaller than 2 dtex are by no means excluded from the scope of the invention since these finer fibres are very suitable for, e.g., textile purposes.

The invention will be further illustrated below with reference to an embodiment depicted in the FIGURE and a number of examples. The FIGURE shows a schematic cross-section of a construction suitable for use in the process according to the invention, but, needless to say, the invention is not restricted to such a construction.

A centrifuge 1 having a diameter of 30 cm is connected to a feed pipe 2 for the spinning solution. At the point where the centrifuge 1 changes over to the feed pipe 2 there is a seal 3 (a so-called viscous seal). The centrifuge 1 is made of stainless steel and is double-walled in order to keep the spinnerets 9 (which are made of a 70/30 Au/Pt alloy) at a particular temperature by having a hot liquid flow around them. A number of spinnerets 9 is spaced out evenly across the circumference of the centrifuge. Each spinneret 9 has several spinning orifices. The spinning orifices are made up of a conical section (inflow) and a cylindrical section (outflow), and the ratio of the overall height of the spinning orifice to the diameter of the cylindrical section is 1.5. Provided around the centrifuge 1 is a jacket 4 with an inner diameter of 50 cm. The jacket 4 is made of polyvinyl chloride (PVC) and has an annular channel 5 at the top. Connected to this annular channel are feed pipes 6 through which the coagulant can be supplied. If there is a supply of coagulant, it will fill up the annular channel 5. The coagulant cannot leave the annular channel 5 except through the orifice 7, which is also annular. Depending on the width of the orifice 7 and the quantity of coagulant supplied, a curtain or film 8 will form on the jacket 4. After extrusion through the spinnerets 9 the fibres or filaments end up in the coagulant. The coagulant ensures that the fibres or filaments reach the solid state and also sees to their discharge. At the open bottom of the jacket 4 is placed a slanting receptacle 10. The receptacle 10 is tapered, and at the end the water from the receptacle 10 flows to a drain. The sliver, which has become somewhat narrower because of this tapering, is passed to the washing plant.

EXAMPLE 1

Fibres of pure polymer a) Preparation of the pure polymer

As specified in the procedure disclosed in Example 6 of U.S. Pat. No. 4,308,374, poly(para-phenylene terephthalamide) (PPTD) was prepared using a mixture of N-methyl pyrrolidone and calcium chloride. After neutralisation, washing, and drying a polymer was obtained which had an inherent viscosity of 5.4.

b) Preparation of a spinning solution of the pure polymer

The solvent used was sulphuric acid in a concentration of 99.8%. The solution was prepared as specified in Example 3 of U.S. Pat. No. 4,320,081. The final PPTD content of the spinning solution was 19.4%. The spinning solution exhibited optical anisotropy.

c) Centrifugal spinning of the spinning solution

The spinning solution was spun in the set-up described above. The selected coagulant was water having a temperature of 15° C. and a volume throughput of 3000 l/hour. The outer diameter of the centrifuge being 30 cm and the inner diameter of the jacket being 50 cm, the so-called airgap was 10 cm. The inner radius of the jacket was 67% wider than the outer radius of the centrifuge. The number of spinning orifices was 48. The sliver was discharged, neutralised, washed, and wound in a continuous process under all of the aforementioned conditions.

The other parameters (Rotation=rotational speed, Dorf=diameter of the spinning orifices, Press=excess pressure in the centrifuge, Through=mass throughput of the spinning solution, Draw=draw ratio of fibres or filaments) are listed in Table 1. In addition, it should be noted that in this example the excess pressure in the centrifuge is a so-called output parameter, which is independent of the rotational speed and the throughput set.

EXAMPLE 2 fibres made from spinning process residuals a) Preparation of a spinning solution of spinning process residuals 330 g of coarsely ground spinning process residuals were fed to an IKA duplex kneader in two portions at an interval of about 5 minutes. There was kneading in vacuo at 87° C. for half an hour, after which 18.4 g of sulphuric acid (99.8%) were added. Then there was another half hour of kneading, after which all of the spinning solution was melted. The calculated aramid content was 18.4%.

b) Centrifugal spinning of a spinning solution

A spinning solution prepared in accordance with a) was spun in the set-up described above, except that an open centrifuge was employed. The temperature of the coagulant was 13° C., the number of spinning orifices was 300. The other parameters are listed in Table 1, experiment no. 15.

EXAMPLE 3 fibres having a high filament count

The spinning solution of Example 2 was spun under the conditions specified for said example, except that the number of spinning orifices was 72. The other parameters are listed in Table 1, experiment no. 16.

EXAMPLE 4 fibres having a low filament count

The spinning solution of Example 1 was spun under the conditions specified for said example, except that the number of spinning orifices was 144. The other parameters are listed in Table 1, experiment no. 17. After being spun, the fibres of this example were dried with an apron drier at a temperature of 90° C. for 3 minutes to a moisture content of 8%.

EXAMPLE 5 fibres spun at high throughput

The spinning solution of Example 1 was spun under the conditions specified for said example, except that the number of spinning orifices was 576. The coagualant consisted of water containing 17.2% sulphuric acid and the inner diameter of the jacket was 60 cm (i.e., 100% wider than the outer radius of the centrifuge). The other parameters are listed in Table 1, experiment no. 18.

EXAMPLE 6 fibres spun at high rotation

The spinning solution of Example 1 was spun under the conditions specified for said example, except that the number of spinning orifices was 60. The other parameters are listed in Table 1, experiment no. 19.

The term 'Draw' in Table 1 is used to denote the calculated (by dividing the take-off speed by the speed of the solution in the spinning orifice) draw ratio.

TABLE 1

| Exp. no. | Rotation rpm | Dorf micron | Press bar | Through kg/hour | Draw — | Take-off sp. m/s |
|---|---|---|---|---|---|---|
| 1 | 2000 | 250 | 23 | 24 | 32.2 | 52.4 |
| 2 | 3000 | 250 | 23 | 36 | 32.2 | 78.5 |
| 3 | 3000 | 250 | 3 | 12 | 96.6 | 78.5 |
| 4 | 1000 | 250 | 3 | 12 | 32.2 | 26.2 |
| 5 | 1000 | 250 | 35 | 36 | 10.7 | 26.2 |
| 6 | 2000 | 400 | 8 | 24 | 82.4 | 52.4 |
| 7 | 3000 | 400 | 3 | 12 | 247.3 | 78.5 |
| 8 | 3000 | 400 | 6 | 36 | 82.4 | 78.5 |
| 9 | 2000 | 400 | 7 | 24 | 82.4 | 52.4 |
| 10 | 1000 | 400 | 18 | 36 | 27.5 | 26.2 |
| 11 | 2000 | 400 | 8 | 12 | 164.9 | 52.4 |
| 12 | 2000 | 150 | 64 | 24 | 11.6 | 52.4 |
| 13 | 3000 | 150 | 26 | 12 | 34.8 | 78.5 |
| 14 | 3000 | 150 | 74 | 36 | 11.6 | 78.5 |
| 15 | 4000 | 275 | — | 60 | 194.8 | 104.7 |
| 16 | 2000 | 400 | 12 | 36 | 83.0 | 52.4 |

TABLE 1-continued

| Exp. no. | Rotation rpm | Dorf micron | Press bar | Through kg/hour | Draw — | Take-off sp. m/s |
|---|---|---|---|---|---|---|
| 17 | 3000 | 400 | 9 | 36 | 166.0 | 78.5 |
| 18 | 2250 | 250 | 60 | 150 | 173.9 | 70.7 |
| 19 | 5000 | 350 | — | 10 | 459.5 | 130.9 |

The filament strength of Examples 5, 12, 14, and 19 was measured in accordance with ASTM/DIN D2256-90 giving 13.75, 15.24, 14.20, and 20.00 cN/dtex respectively.

EXAMPLE 7

Processing of the sliver into pulp

The slivers obtained according to Examples 1, 2, 3, 4 and 5 and four samples of fibres obtained via a conventional wet spinning process (experiment nos. v1–v4) after being neutralised and washed were passed to a cutter (Neumag NMC 150) and cut up into pieces of 6 mm in length. The pieces were fibrillated in a refiner and pulped. Both the pulp and a gasket made of said pulp have exceptionally favourable properties, cf. Tables 2 and 3, respectively. (SR=Schopper-Riegler number, SSA=specific surface area, AL=average fibre length, WL=weighed fibre length, GP=gas permeability, Ql=gasket strength in longitudinal direction of the fibres, Qw=gasket strength in transverse direction to the fibres, Sieve=sieve fraction, Wet dens.=wet density. Note: measuring techniques with regard to pulp properties have not been standardised yet. Where possible, the measuring methods employed derive from the paper industry (TAPPI standards)).

TABLE 2

| Exp. no. | SR | SSA $m^2/g$ | AL m | WL m |
|---|---|---|---|---|
| 1 | 29 | 4.67 | 0.54 | 2.09 |
| 2 | 29 | 5.31 | 0.53 | 2.49 |
| 3 | 24 | 4.29 | 0.66 | 2.93 |
| 4 | 22 | 2.58 | 0.54 | 1.70 |
| 5 | 26 | 3.06 | 0.47 | 1.90 |
| 6 | 29 | 4.08 | 0.53 | 2.12 |
| 7 | 26 | 4.58 | 0.58 | 2.50 |
| 8 | 27 | 4.05 | 0.54 | 2.56 |
| 9 | 25 | 4.34 | 0.53 | 2.17 |
| 10 | 28 | 3.23 | 0.47 | 1.40 |
| 11 | 29 | 2.97 | 0.53 | 1.88 |
| 12 | 26 | 4.48 | 0.54 | 2.75 |
| 13 | 22 | 2.58 | 0.74 | 2.66 |
| 14 | 27 | 5.43 | 0.55 | 2.60 |
| 15 | 26 | 4.26 | 0.62 | 2.24 |
| 16 | — | 2.89 | 0.57 | 1.88 |
| 17 | — | 3.20 | 0.68 | 1.80 |
| 18 | 15 | 1.81 | 0.66 | 1.90 |
| v1 | 30 | 8.41 | 0.76 | 2.20 |
| v2 | 30 | 8.43 | 0.66 | 1.92 |
| v3 | 29 | 8.32 | 0.70 | 2.22 |
| v4 | 24 | 6.48 | 0.87 | 2.63 |

TABLE 3

| Exp. no. | GP | Ql MPa | Qw MPa | Sieve % | Wet dens. ml | Take-off m/s |
|---|---|---|---|---|---|---|
| 1 | 5.20 | 35.15 | 10.71 | 90.9 | 2100/710 | 52.4 |
| 2 | 4.90 | 44.46 | 11.28 | 91.5 | 2100/935 | 78.5 |
| 3 | 0.67 | 42.83 | 11.46 | 82.4 | 2100/855 | 78.5 |
| 4 | 1.80 | 28.58 | 9.84 | 79.6 | 2100/510 | 26.2 |
| 5 | 4.33 | 30.50 | 8.92 | 89.0 | 2100/525 | 26.2 |

TABLE 3-continued

| Exp. no. | GP | Ql MPa | Qw MPa | Sieve % | Wet dens. ml | Take-off m/s |
|---|---|---|---|---|---|---|
| 6 | 5.31 | 39.04 | 11.31 | 92.0 | 2100/760 | 52.4 |
| 7 | 6.23 | 44.26 | 10.98 | 85.5 | 2100/875 | 78.5 |
| 8 | 3.90 | 40.96 | 10.75 | 90.8 | 2100/910 | 78.5 |
| 9 | 2.30 | 42.11 | 10.47 | 89.0 | 2100/975 | 52.4 |
| 10 | 3.30 | 32.11 | 9.46 | 90.0 | 2100/545 | 26.2 |
| 11 | 2.80 | 33.13 | 9.85 | 87.1 | 2100/535 | 52.4 |
| 12 | 4.70 | 41.49 | 10.66 | 87.9 | 2100/900 | 52.4 |
| 13 | 3.33 | 36.10 | 10.32 | 42.1 | 2100/805 | 78.5 |
| 14 | 4.40 | 45.52 | 11.10 | 90.7 | 2100/965 | 78.5 |
| 15 | 0.17 | 38.50 | 11.93 | 83.1 | 2100/755 | 104.7 |
| 16 | 1 | 30.12 | 9.68 | 48.2 | 2100/450 | 52.4 |
| 17 | 1.5 | 29.67 | 9.37 | 22.6 | 2100/470 | 78.5 |
| 18 | 1.13 | 32.27 | 9.85 | 26.5 | 2100/380 | 70.7 |
| v1 | — | 40.70 | 11.50 | 83.2 | 2000/650 | — |
| v2 | — | 38.30 | 11.10 | 81.9 | 2000/340 | — |
| v3 | — | 40.30 | 11.40 | 82.1 | 2000/655 | — |
| v4 | 0.10 | 43.20 | 11.29 | 76.1 | 2100/725 | — |

When determining the suitability of pulp as raw material for gasket or friction material, the Qw and sieve fraction parameters are especially important. Qw is normative as to the strength of such materials, because it is always lower than Ql. The sieve fraction is a direct measure of the pulp's particle retaining capacity, so providing an indirect indication of the cohesion of the material in the finished product (packing, brake shoe, etc.). The tables show very clearly that the pulp quality improves with increasing take-off speed. At high take-off speeds this quality even surpasses that of pulp made of fibres from a conventional wet spinning process.

What is claimed is:

1. A process for spinning fibers or filaments from a spinnable solution using a centrifuge of which the wall has one or more spinning orifices and in which process the spinning solution is jetted from the centrifuge into a coagulant inside a jacket wherein the inner radius of the jacket is at least 35% wider than the radius of the outer circumference of the centrifuge.

2. The process of claim 1 wherein the angular velocity of the centrifuge multiplied by the inner radius of the jacket is higher than 20 m/s.

3. The process of claim 1 wherein the spinnable solution is an optically anisotropic solution.

4. The process of claim 1 wherein the wholly or partially coagulated fibers or filaments are joined together to form a sliver, after which the sliver is neutralized and/or dried and/or washed in a continuous process.

5. The process of claim 1 wherein the difference between the inner radius of the jacket and the outer radius of the centrifuge is more than 7 cm.

6. The process of claim 1 wherein the diameter of the centrifuge is larger than 20 cm and smaller than 60 cm.

7. The process of claim 1 wherein the centrifuge has a rotational speed in the range of 1000 to 5000 rpm.

8. The process of claim 1 wherein the centrifuge is provided with such means as will permit the spinnable solution to be supplied under pressure.

9. Fibers and filaments obtained by the process of claim 1 wherein the fibers and filaments contain numerous elongated or spherical voids.

10. Fibers and filaments obtained by the process of claim 1 wherein the polymer at and beneath the fiber surface has essentially the same structure as the polymer in the fiber core.

11. Pulp made from the fibers of claim 9.

12. A process for spinning fibers or filaments from a spinnable solution using a centrifuge of which the wall has one or more spinning orifices and in which process the spinning solution is jetted from the centrifuge into a coagulant inside a jacket wherein the angular velocity of the centrifuge multiplied by the inner radius of the jacket is higher than 20 m/s.

13. Fibers and filaments obtained by the process of claim 12 wherein the fibers contain numerous elongated or spherical voids.

14. Fibers and filaments obtained by the process of claim 12 wherein the polymer at and beneath the fiber surface has essentially the same structure as the polymer in the fiber core.

15. Pulp made of the fibers of claim 13.

16. Pulp made of the fibers of claim 10.

17. Pulp made of the fibers of claim 14.

* * * * *

UNITED STATES PATENT AND TRADEMARK OFFICE

CERTIFICATE OF CORRECTION

PATENT NO. : 6,159,597
DATED : December 12, 2000
INVENTOR(S) : Johannes Jacobus Meerman and Roelof Jelijs It is certified that error appears in the above-identified patent and that said Letters Patent is hereby corrected as shown below:

Title page,
Add item [30], Foreign Application Priority Data:
-- Mar. 3, 1995 [NL] Netherlands 9500420 --.

Item [56], FOREIGN PATENT DOCUMENTS, add:

| | | |
|---|---|---|
| -- 9104700 | 12/1998 | Rep. of Korea |
| 92346800 | 07/1991 | Rep. of Korea |
| 93262442 | 10/1992 | Rep. of Korea --. |

Signed and Sealed this

Ninth Day of October, 2001

*Attest:*

Nicholas P. Godici

*Attesting Officer*

NICHOLAS P. GODICI
*Acting Director of the United States Patent and Trademark Office*